United States Patent [19]

Weinberger

[11] 3,996,321

[45] Dec. 7, 1976

[54] LEVEL CONTROL OF DRY-JET WET SPINNING PROCESS

[75] Inventor: Charles Brian Weinberger, Media, Pa.

[73] Assignee: E. I. Du Pont de Nemours and Company, Wilmington, Del.

[22] Filed: Nov. 26, 1974

[21] Appl. No.: 527,347

[52] U.S. Cl. ..... 264/40.3; 264/181; 264/184; 425/71

[51] Int. Cl.[2] ..... D01D 5/14

[58] Field of Search ..... 264/181.40, 184; 425/181, 40, 184

[56] References Cited

UNITED STATES PATENTS

| | | | |
|---|---|---|---|
| 3,412,191 | 11/1968 | Kitajima et al. | 264/180 |
| 3,767,756 | 10/1973 | Blades | 264/184 |
| 3,842,151 | 10/1974 | Stoy et al. | 264/184 |

FOREIGN PATENTS OR APPLICATIONS

| | | | |
|---|---|---|---|
| 45-2765 | 1/1970 | Japan | 264/181 |

*Primary Examiner*—Jay H. Woo

[57] ABSTRACT

In a process for forming fibers by extruding a spinning dope successively through a layer of inert gas and a tube immersed in a coagulating bath, the tension profile of the yarn passing through the tube is regulated by regulating the pressure of the layer inert gas. In this pressurized quench system, the coagulating liquid is maintained at a predetermined level, despite transient changes in liquid input, by passing both pressurized gas and coagulating liquid through a pipe having an opening at the level to be maintained.

3 Claims, 1 Drawing Figure

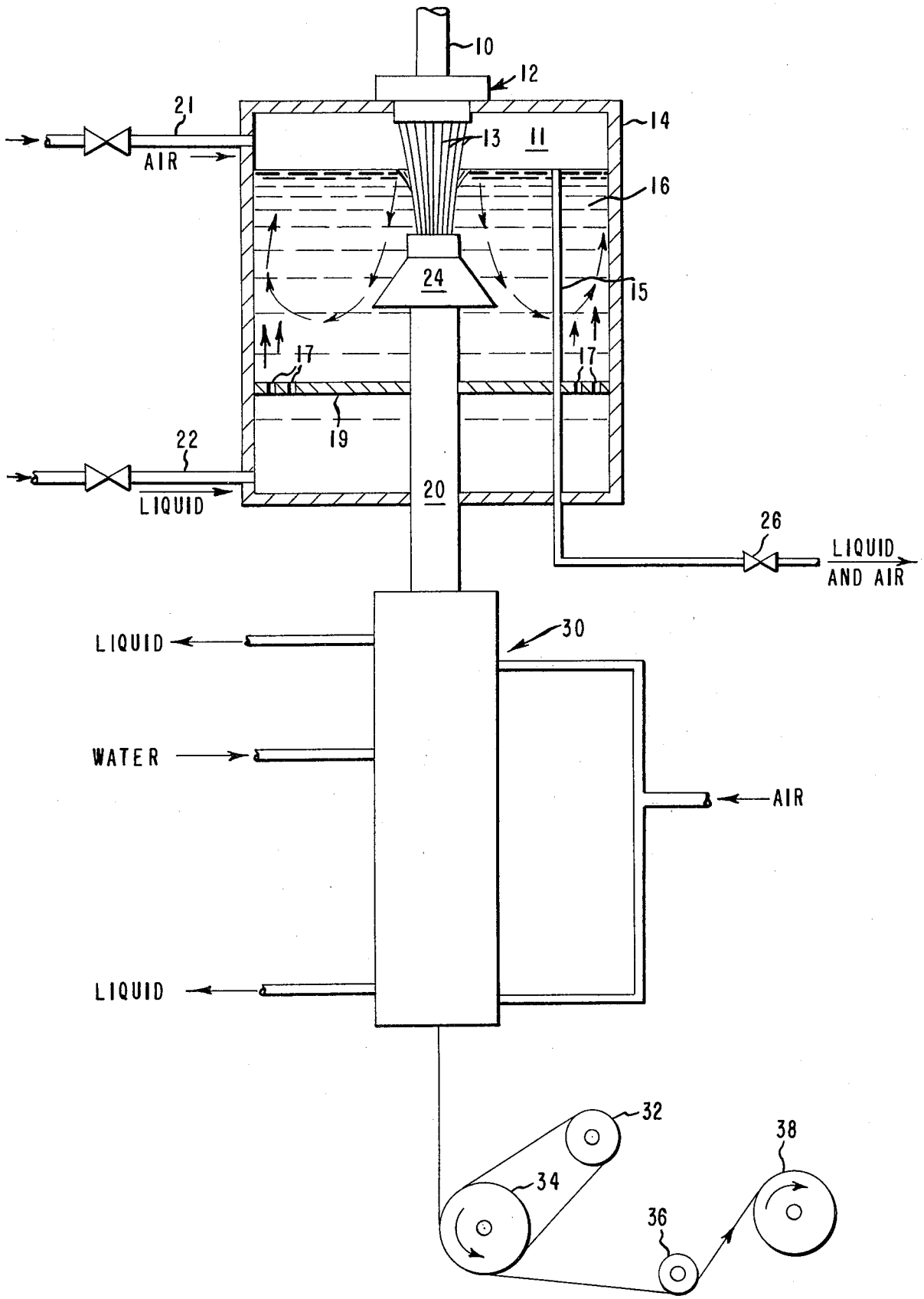
10
12
21
14
13
11
AIR
16
24
15
17
17
19
22
20
LIQUID
26
LIQUID
AND AIR
30
LIQUID
WATER
AIR
LIQUID
32
38
34
36

LEVEL CONTROL OF DRY-JET WET SPINNING PROCESS

BACKGROUND OF THE INVENTION

This invention relates to an improved process for the preparation of fibers from spinning dopes and more particularly to the process of extruding the dope from an orifice through a layer of inert gas into a coagulating bath to form fibers.

The prior art U.S. Pat. No. 3,767,756 to Blades teaches a dry jet wet spinning process wherein a dope is extruded from orifices as filaments which are then passed through a layer of inert gas into a quench bath and through a spin tube along with a portion of the quench liquid from the bath. The filaments are separated from the liquid and wound upon a bobbin. The spinning technology disclosed by Blades requires that the spinneret face be separated from the quench bath by a layer of gas the thickness of which must be controlled by controlling the level of the quench bath. Coupled with this requirement is the need to control the speed of the quench liquid with respect to filament speed to regulate the tension profile of the yarn during coagulation to provide a uniform product of high strength.

An object of this invention is to control the speed of the quench liquid surrounding the filaments in a gas gap spinning process while providing self-regulating level control for the quench bath.

SUMMARY OF THE INVENTION

The objects of this invention may be accomplished by extruding a spinning dope from an orifice through a layer of inert gas and through a liquid quench bath by passing the fiber through a tube in said bath co-currently with a portion of said bath and adding quench liquid to said bath in an amount at least as great as said portion. A pressure is applied to the inert gas to increase the flow of quench liquid through said tube while the liquid in the bath is regulated at a predetermined level by passing both said pressurized inert gas and quench liquid through a restricted pipe opening at said level.

BRIEF DESCRIPTION OF THE DRAWING

The drawing is a schematic view of apparatus suitable for carrying out the process of this invention.

DETAILED DESCRIPTION OF THE PREFERRED EMBODIMENT

The wet spinning apparatus chosen for purposes of illustration is that used in the spinning process of Blades U.S. Pat. No. 3,767,756 and includes as general components thereof a transfer line 10 through which is pumped spinning dope to a spinning block 12 located in the top of tank 14 containing a liquid quench bath 16 supplied from pipe 22. A spin tube 20 is immersed in the bath 16, extends through vessel 14 and connects to the extraction and washing apparatus generally designated as 30. Extruded filaments 13 are forwarded through a layer of gas 11, then through tube 20 into extraction washing apparatus 30 which removes quench liquid and washes the filaments. The filaments are withdrawn from extraction wash apparatus 30 by driven roll 34 and its associated separator roll 32 and conducted under guide 36 for winding on rotating bobbin 38.

Both gas and quench liquid are fed to the quench bath tank 14 via pipe lines 21 and 22 connected to the tank. The gas flows from a source (not shown) through pipe 21 into the layer of gas 11 at the top of tank 14 and then out through pipe 15 and throttling valve 26 to atmosphere. The majority of the quench liquid issues through the spin tube 20 with a small amount going out through the pipe 15 which serves as a level control device and has its open end located at the level desired for operation of the bath. The quench liquid entering the tank passes through holes 17 in plate 19. The holes are arranged concentrically about the outer periphery of plate 19. This arrangement breaks up the flow of liquid into the tank and promotes quiescense in the upper part of the tank which is important to the production of uniform filaments.

The entrance to spin tube 20 is capped with a deflector shield 24 in the shape of an inverted funnel. This particular design is based on the premise that the filaments 13 in their movement toward tube 20 pump more quench liquid than actually goes into the tube with the filaments. This excess liquid must be diverted with a minimum of turbulence. The inverted funnel design allows the liquid to continue toward the bottom of the tank after the threadline enters the tube 20 then the downward flow is directed to the outside of tank 20 to join the flow through holes 17 as indicated by the flow arrows in the tank 14.

In operation, a constant flow of air is admitted into the tank 14 through pipe 21 and flows out through the level control pipe 15 and valve 26 which restricts the outflow of air to the atmosphere. The velocity of the quench liquid in spin tube 20 is established by the setting of the pressure in gap 11 with higher pressures corresponding to higher liquid flows. The self-regulating feature of pipe 15 works as follows when operating at a nominally fixed gas flow and water flow and the level of liquid in the tank is, for example, reduced temporarily as a result of transient surges in the flow of the gas or water: as the level of liquid progressively decreases, increased amounts of gas flow through pipe 15, thereby lowering the pressure in the gas space 11, reducing the water flow through tube 20 and hence, raising the level of liquid in the tank. Conversely, transient surges raise the liquid level, reduce the amount of gas flowing through pipe 15, increase gas pressure in space 11, increase the liquid flow through tube 20 and hence, lowers the liquid level in the tank.

EXAMPLE

In a typical operation a spinning solution of a polymer in sulfuric acid (as taught in Blades U.S. Pat. No. 3,767,756) is used. The filaments pass at 500 yards/minute (456 meters/minute) through an 0.5 inch (1.27 cm.) layer of gas 11 into tube 20 having an inside diameter of 0.34 inch (8.66 mm.) and the top of which is located about 2 inches (5.08 cm.) below the level portion of the liquid 16. Water flows through tube 20 and pipe 15 which has an inside diameter of about 0.062 inch (1.58 mm.) at rates of about 6.0 and 0.02 gallons (22.6 and 0.07 liters) per minute, respectively. A gas flow of about 0.15 standard cubic feet (0.0045 cubic meters) per hour flows through gas layer 11, at about 8 pounds per square inch (0.56 kilo grams per square cm.) gage, and out pipe 15. No visible change in the thickness of the gas layer 11 is observed during spinning despite transient changes in the supply of water. If the top of pipe 15 is abruptly moved up (or down), e.g., 0.25 inch (6.25 mm.) during spinning, the thickness of the gas layer readjusts and comes to the new level within 5–7 seconds.

What is claimed is:

1. In a wet spinning process for forming fibers that includes the steps of extruding a spinning dope from an orifice through a layer of inert gas and through a liquid quench coagulating bath by passing the fiber through a tube in said bath co-currently with a portion of said bath and adding quench liquid to said bath in an amount at least as great as said portion, the improvement comprising: applying a gas pressure to said layer of inert gas; self-regulating the inert gas pressure in said layer; and self-regulating the liquid in said bath at a predetermined level by continuously passing the pressurized inert gas and quench liquid through a restricted pipe having an opening at said level.

2. The process as defined in claim 1, said gas pressure being constant.

3. The process as defined in claim 1, said gas being air.

* * * * *